US007926902B2

(12) United States Patent
Umeda

(10) Patent No.: US 7,926,902 B2
(45) Date of Patent: Apr. 19, 2011

(54) DROPLET EJECTING DEVICE

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 274 days.

(21) Appl. No.: 12/272,473

(22) Filed: Nov. 17, 2008

(65) Prior Publication Data

US 2009/0135231 A1 May 28, 2009

(30) Foreign Application Priority Data

Nov. 28, 2007 (JP) ..... 2007-306705

(51) Int. Cl.
*B41J 29/393* (2006.01)
*B41J 2/14* (2006.01)
*B41J 2/045* (2006.01)

(52) U.S. Cl. ..... 347/19; 347/47; 347/70

(58) Field of Classification Search ..... 347/19, 347/47, 68–72
See application file for complete search history.

(56) References Cited

U.S. PATENT DOCUMENTS

2007/0120897 A1* 5/2007 Chou ..... 347/68

FOREIGN PATENT DOCUMENTS

| | | | |
|---|---|---|---|
| JP | 2000-190490 A | | 7/2000 |
| JP | 2000190490 | * | 7/2000 |
| JP | 2003-211666 A | | 7/2003 |
| JP | 2006-076311 A | | 3/2006 |

* cited by examiner

*Primary Examiner* — Geoffrey Mruk
(74) *Attorney, Agent, or Firm* — Baker Botts L.L.P.

(57) ABSTRACT

At least one liquid channel has a channel area larger than a channel area of the at least one nozzle. A nozzle plate is formed with the at least one nozzle and includes a piezoelectric section. The nozzle plate has a first surface and a second surface opposite the first surface. A channel structure member is fixed to the nozzle plate and is formed with the at least one liquid channel. A first electrode is provided on the first surface. At least part of the first electrode is arranged in a nozzle peripheral region of the at least one nozzle. A second electrode is provided on the second surface. At least part of the second electrode is arranged in the nozzle peripheral region of the at least one nozzle. An energy applying section applies ejection energy to liquid in the at least one liquid channel.

13 Claims, 10 Drawing Sheets

DROPLET EJECTING DEVICE

CROSS REFERENCE TO RELATED APPLICATIONS

This application claims priority from Japanese Patent Application No. 2007-306705 filed Nov. 28, 2007. The entire content of the priority application is incorporated herein by reference.

TECHNICAL FIELD

The invention relates to a droplet ejecting device that ejects droplets from nozzles.

BACKGROUND

Conventionally, an inkjet printer serving as a droplet ejecting device is provided with an inkjet head having nozzles that eject ink droplets onto printing paper for printing an image and the like onto the printing paper. In such an inkjet printer, there arises a problem that ink cannot be ejected from nozzles due to the causes of an increase in viscosity of ink within an ink channel of the inkjet head (hereinafter also referred to as "increased viscosity"), entering of an air bubble into the ink channel, and the like. Hence, a common inkjet printer is configured to perform various maintenance processes, such as a suction purge operation of sucking ink through nozzles and a flushing operation of ejecting ink droplets continuously a plurality of times from the nozzles toward a waste ink receiver prior to or during printing, thereby discharging ink with increased viscosity and an air bubble, together with ink, for recovering the droplet ejection performance of the nozzles.

During the above-described maintenance processes, ink is discharged through the nozzles together with viscosity-increased ink and an air bubble. Thus, if the maintenance processes are performed frequently, the amount of ink discharged vainly increases. Hence, in order to suppress the ink consumption amount during maintenance, a proposed inkjet printer is configured to detect whether nozzles are in a non-ejection state (ejection malfunction) and then to perform a maintenance process only when the non-ejection state is detected in the nozzles.

An inkjet printer disclosed in Japanese Patent Application Publication No. 2006-76311 includes: a serial-type inkjet head (print head) that ejects droplets onto printing paper while moving in a predetermined scanning direction in a reciprocating manner; and a missing-dot detecting section provided at a location outside of a printing region with respect to the scanning direction, the printing region being in confrontation with the printing paper. The missing-dot detecting section includes a light emitting section that emits laser light and a light receiving section that receives the laser light emitted from the light emitting section.

When detecting whether one or more nozzles are in a non-ejection state, a control section of the inkjet printer first controls the inkjet head to move to a region where the light emitting section and the light receiving section of the missing-dot detecting section are arranged, the region being outside of the printing region. Then, the control section controls the nozzles to eject ink droplets in a state where the light emitting section emits laser light toward the light receiving section. At this time, when a droplet is ejected from a nozzle, the ejected droplet blocks part of the laser light. In contrast, when no droplet is ejected from the nozzle, the laser light is not blocked. Accordingly, it is possible to detect whether a droplet is ejected from the nozzle based on a drop amount of light intensity of the laser light received by the light receiving section.

SUMMARY

In the inkjet printer disclosed in Japanese Patent Application Publication No. 2006-76311, the missing-dot detecting section that detects whether one or more nozzles of the inkjet head are in a non-ejection state is disposed in a region outside of the printing region with respect to the scanning direction, the missing-dot detecting section being separate from the inkjet head. Hence, an additional space for disposing the missing-dot detecting section needs to be secured within the main body of the printer, which causes a problem that the size of the printer increases.

Additionally, unless the inkjet head is moved to the location of the missing-dot detecting section disposed outside of the printing region, a non-ejection state of the nozzles cannot be detected. Thus, the missing-dot detecting section cannot detect a non-ejection state of the nozzles concurrently with a normal printing operation that is performed while the inkjet head moves within the printing region in a reciprocating manner, or a flushing operation that is performed toward the waste ink receiver disposed at a location separate from the missing-dot detecting section. Hence, there is possibility that detection of a non-ejection state of the nozzles is delayed, and that printing operations continue to be performed for a while in a state where a non-ejection state exists.

In view of the foregoing, it is an object of the invention to provide a droplet ejecting device that is capable of detecting whether an ejection state of droplets is normal, without increasing the size of the device. Another object of the invention to provide a droplet ejecting device that is capable of detecting abnormal ejection at an early time.

In order to attain the above and other objects, the invention provides a droplet ejecting device. The droplet ejecting device includes a channel unit and an energy applying section. The channel unit is formed with at least one nozzle that ejects a liquid droplet and with at least one liquid channel in communication with the at least one nozzle. The at least one liquid channel has a channel area larger than a channel area of the at least one nozzle. The channel unit includes a nozzle plate, a channel structure member, a first electrode, and a second electrode. The nozzle plate is formed with the at least one nozzle and includes a piezoelectric section. The nozzle plate has a first surface and a second surface opposite the first surface. The channel structure member is fixed to the nozzle plate and is formed with the at least one liquid channel. The first electrode is provided on the first surface. At least part of the first electrode is arranged in a nozzle peripheral region of the at least one nozzle. The second electrode is provided on the second surface. At least part of the second electrode is arranged in the nozzle peripheral region of the at least one nozzle. The energy applying section applies ejection energy to liquid in the at least one liquid channel.

BRIEF DESCRIPTION OF THE DRAWINGS

Embodiments in accordance with the invention will be described in detail with reference to the following figures wherein:

FIGS. 7A through 7C are cross-sectional views showing deformation states of a nozzle plate when pressure is applied to ink within a pressure chamber, wherein FIG. 7A shows a normal ejection state, FIG. 7B shows a non-ejection state, and FIG. 7C shows a state where ejection direction is slanted;

FIGS. 9A and 9B are cross-sectional views showing deformation states of the nozzle plate in the nozzle peripheral part when the ejection direction is slanted, wherein FIG. 9A shows a state prior to changing the ejection direction, and FIG. 9B shows a state after changing the ejection direction;

DETAILED DESCRIPTION

A droplet ejecting device according to an embodiment of the invention will be described while referring to FIGS. 1 through 9B. The droplet ejecting device of the embodiment is applied to a printer (inkjet recording device) that prints desired texts and images on recording paper by ejecting ink droplets on recording paper from an inkjet head.

In the following description, the expressions "upper" and "lower" are used to define the various parts when the droplet ejecting device is disposed in an orientation in which it is intended to be used.

Figure 1:
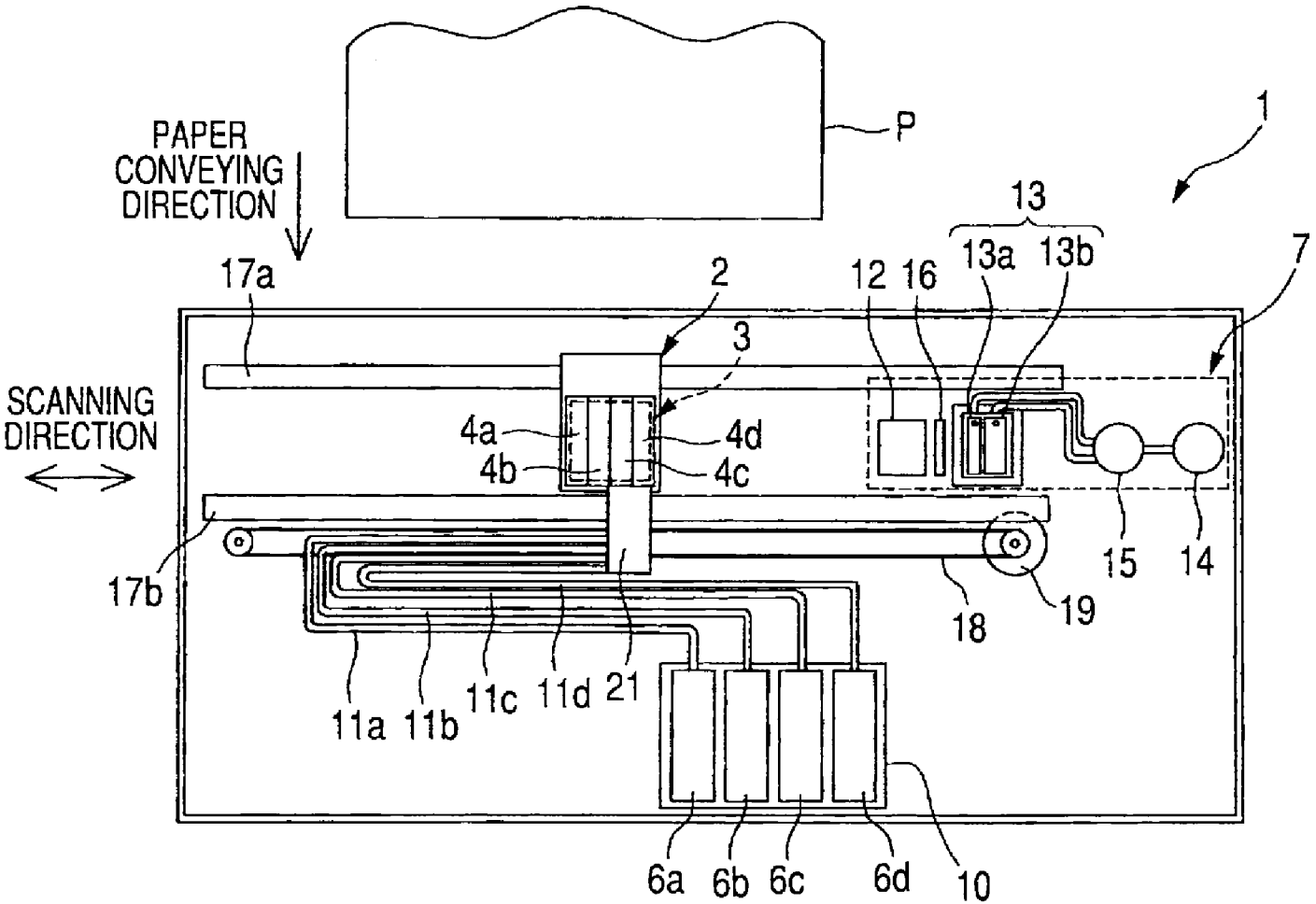
FIG. 1 is a plan view schematically showing the relevant parts of a printer according to an embodiment of the invention.

FIG. 1 is a plan view schematically showing the relevant parts of a printer 1 according to the embodiment. As shown in FIG. 1, the printer 1 (droplet ejecting device) includes a carriage 2 configured to be movable reciprocatingly in one direction (scanning direction), an inkjet head 3 and subsidiary tanks 4*a*-4*d* both mounted on the carriage 2, ink cartridges 6*a*-6*d* that store ink, a maintenance unit 7 that recovers droplet ejection performance when the droplet ejection performance is deteriorated due to entering of air or the like, a control unit 8 (see FIG. 6) that controls various components of the printer 1, and the like.

The printer 1 includes two guide frames 17*a* and 17*b* that extend in a horizontal direction (the left-right direction in FIG. 1, the scanning direction). The two guide frames 17*a* and 17*b* are arranged with a space therebetween in a paper conveying direction perpendicular to the scanning direction. The carriage 2 is movably mounted on the two guide frames 17*a* and 17*b*. An endless belt 18 is connected to the carriage 2. When the endless belt 18 is driven to move by a carriage drive motor 19, the carriage 2 moves in the scanning direction (the left-right direction in FIG. 1) together with the endless belt 18, while being guided by the two guide frames 17*a* and 17*b*.

The inkjet head 3 and the four subsidiary tanks 4 (4*a*-4*d*) are mounted on the carriage 2. Nozzles 40 (see FIGS. 2 through 5B) are provided on the lower surface (the surface at the far side of the drawing sheet in FIG. 1) of the inkjet head 3. The inkjet head 3 moves reciprocatingly in the scanning direction together with the carriage 2, while ejecting ink droplets through the nozzles 40 on printing paper P that is conveyed in the paper conveying direction (the up-to-down direction in FIG. 1) by a paper conveying mechanism (not shown). In this way, desired texts, images, and the like are printed on the printing paper P.

The four subsidiary tanks 4*a*-4*d* are juxtaposed in the scanning direction. The four subsidiary tanks 4*a*-4*d* are connected to respective ones of four ink supply ports 38 (see FIG. 2). A tube joint 21 is connected to the four subsidiary tanks 4*a*-4*d*. Flexible tubes 11*a*-11*d* are connected to the tube joint 21. The four subsidiary tanks 4*a*-4*d* are connected to the respective ones of the four ink cartridges 6*a*-6*d* via the respective ones of the flexible tubes 11*a*-11*d*.

The four ink cartridges 6*a*-6*d* store ink in four colors of black, yellow, cyan, and magenta, respectively. Each of the ink cartridges 6*a*-6*d* is detachably mounted on a holder 10. Ink in four colors stored in the four ink cartridges 6*a*-6*d* is temporarily stored in the subsidiary tanks 4*a*-4*d*, respectively, and is subsequently supplied to the inkjet head 3.

The maintenance unit 7 is located at a position within a reciprocating range of the carriage 2 in the scanning direction, the position being outside (the right side in FIG. 1) of a printing region in confrontation with the printing paper P. The maintenance unit 7 is for performing maintenance processes (ejection-performance recovering operations) including a suction purge operation and a flushing operation, when the nozzles 40 of the inkjet head 3 have ejection malfunction (abnormal ejection) due to increased viscosity of ink within the ink channel of the inkjet head 3 or due to entering of air, dusts, and the like into the ink channel. The suction purge operation is an operation of sucking and discharging ink through the nozzles 40. The flushing operation is an operation of ejecting ink droplets continuously a plurality of times from the nozzles 40.

As shown in FIG. 1, the maintenance unit 7 includes a cap member 13, a suction pump 14, a wiper 16, a waste ink receiver 12, and the like. The cap member 13 is configured to be in close contact with the lower surface of the inkjet head 3 that ejects droplets. The suction pump 14 is connected to the cap member 13. The wiper 16 wipes off ink adhering to the lower surface of the inkjet head 3. The waste ink receiver 12 receives ink that is ejected from the nozzles 40 of the inkjet head 3 during the flushing operation.

During the suction purge operation, the cap member 13, the suction pump 14, the wiper 16, and the like are used. In order to perform the suction purge operation, first the carriage drive motor 19 drives the carriage 2 to move to a position at which the nozzles 40 of the inkjet head 3 are in confrontation with the cap member 13. In that state, the cap member 13 is driven upward (the near side of the drawing sheet of FIG. 1) by a cap drive mechanism (not shown) so as to be in close contact with the lower surface of the inkjet head 3 for covering the plurality of nozzles 40.

The cap member 13 is connected to the suction pump 14 via a switching unit 15. When the suction pump 14 is operated in a state where the cap member 13 covers the nozzles 40 arranged on the lower surface of the inkjet head 3, ink is sucked through the nozzles 40 and discharged. In addition, the inkjet head 3 is configured to move, together with the carriage 2, in the scanning direction relative to the wiper 16, in a state where the cap member 13 is spaced away from the lower surface of the inkjet head 3 after ink is discharged by suction through the nozzles 40. With this operation, ink adhering to the lower surface of the inkjet head 3 is wiped off by the wiper 16.

In the present embodiment, as shown in FIG. 1, the cap member 13 includes a first cap section 13*a* for covering the nozzles 40 that eject black ink and a second cap section 13*b* for covering the nozzles 40 that eject ink in three colors (yellow ink, magenta ink, and cyan ink). The first cap section 13*a* and the second cap section 13*b* are separated from each other. In addition, the first cap section 13*a* and the second cap section 13*b* are connected to the switching unit 15 via tubes, respectively. The switching unit 15 is connected to the suction pump 14. The switching unit 15 is for switching the operating section of the suction pump 14. Accordingly, the switching unit 15 can switch the operating section of the suction pump 14 between the first cap section 13*a* and the second cap section 13*b*, thereby selecting either the nozzles 40 that eject black ink or the nozzles 40 that eject color ink for ink suction.

On the other hand, in order to perform the flushing operation, the carriage drive motor 19 drives the carriage 2 to move to a position at which the plurality of nozzles 40 of the inkjet head 3 is in confrontation with the waste ink receiver 12. The waste ink receiver 12 is provided with an absorbing member such as a sponge. The waste ink receiver 12 is configured to receive ink droplets that are ejected through the nozzles 40 during the flushing operation and to hold the ink by the absorbing member.

Figure 2:
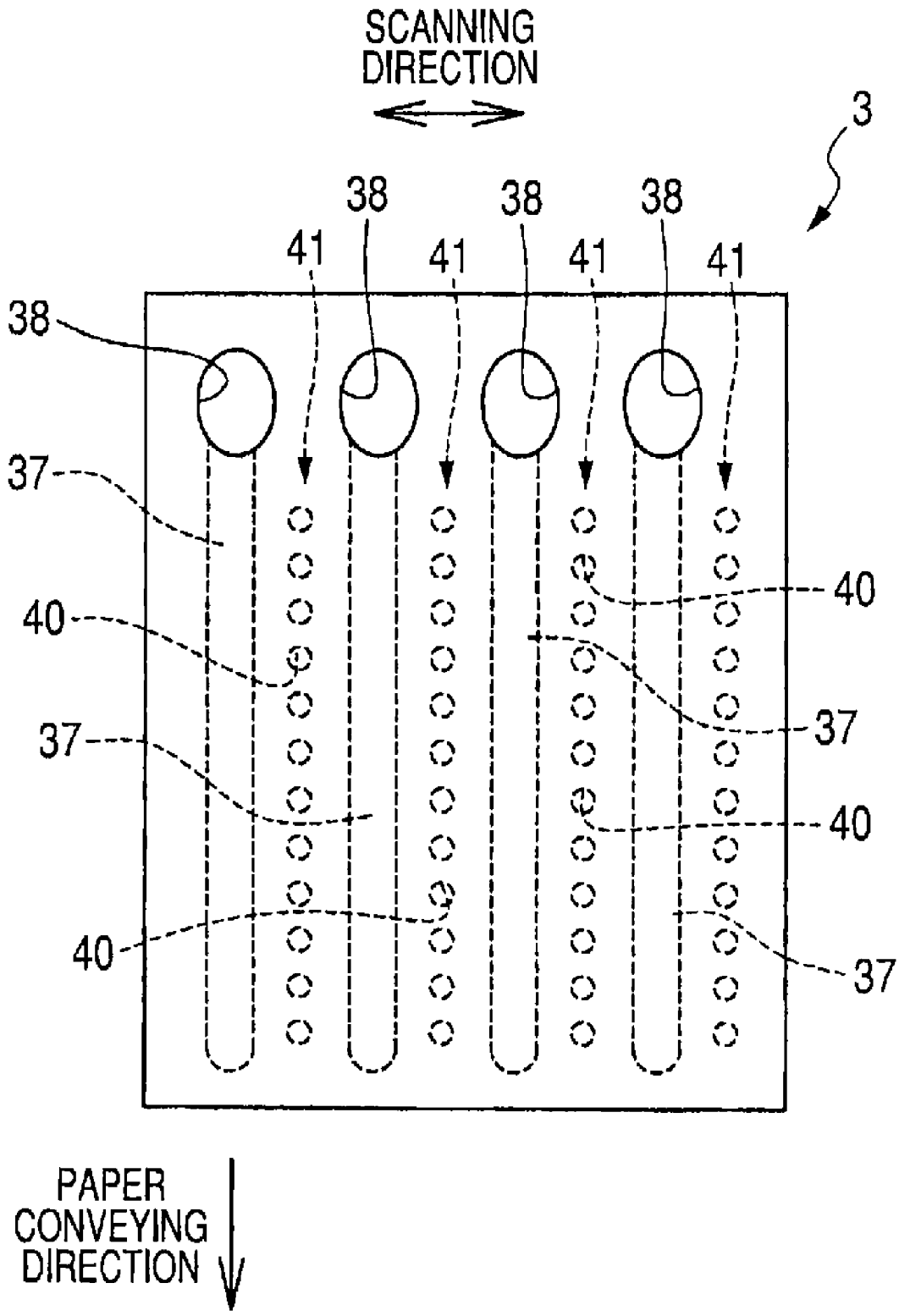
FIG. 2 is a top view showing an inkjet head of the printer shown in FIG. 1.
Figure 3:
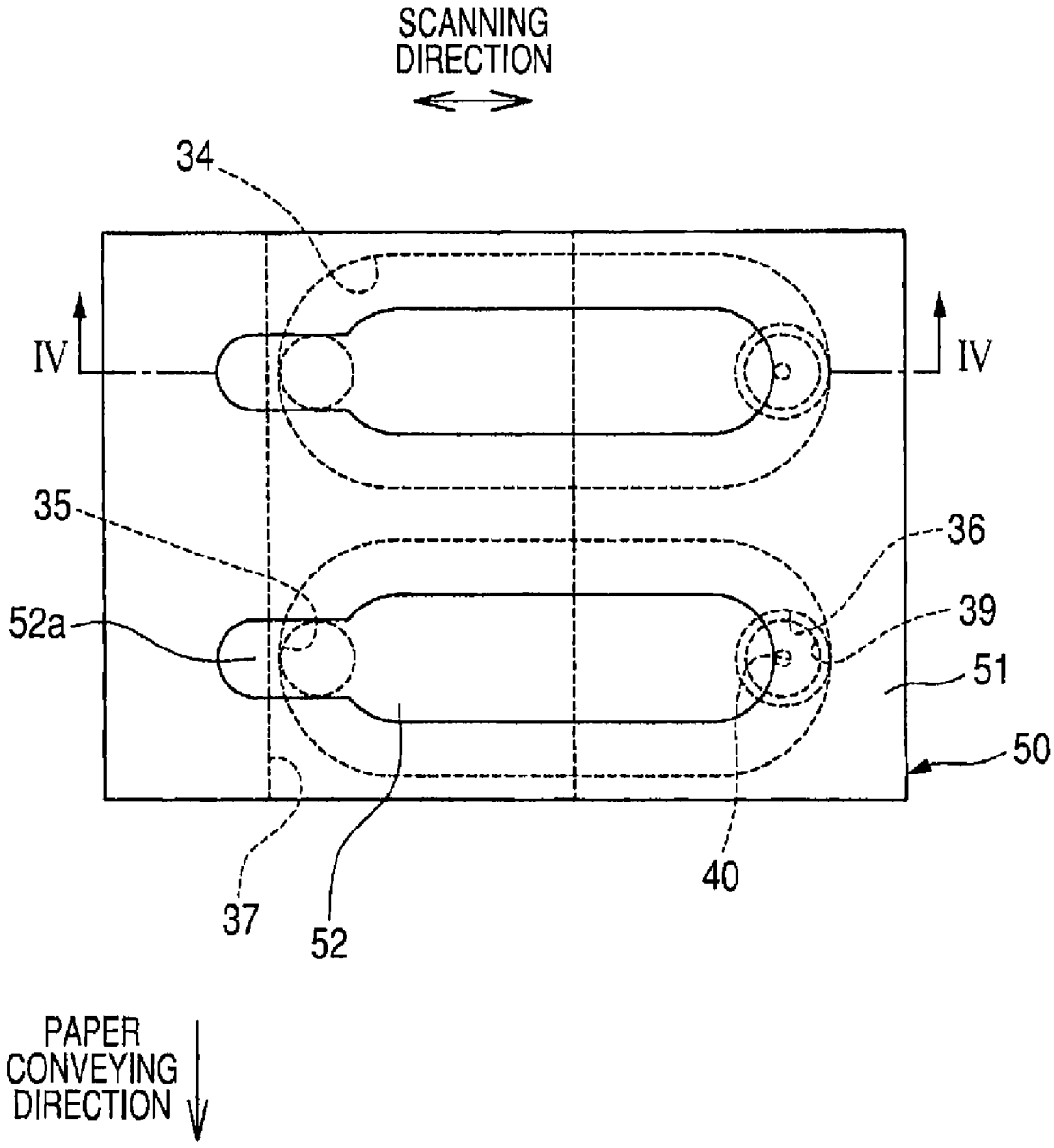
FIG. 3 is a partial enlarged view of FIG. 2.
Figure 4:
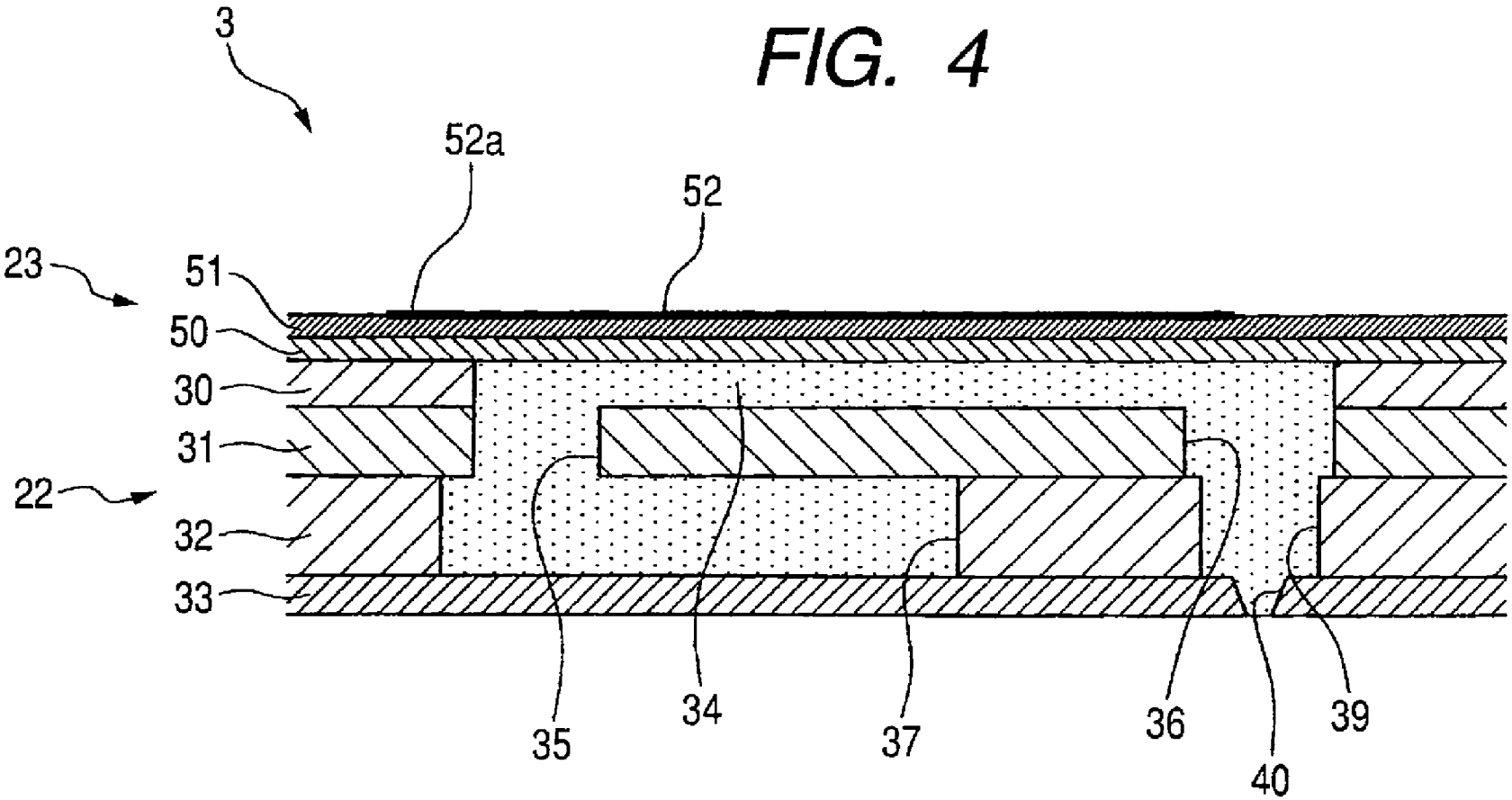
FIG. 4 is a cross-sectional view taken along a line IV-IV in FIG. 3.

Next, the inkjet head 3 will be described in greater detail. FIG. 2 is a top view showing the inkjet head 3 of the printer 1 shown in FIG. 1. FIG. 3 is a partial enlarged view of FIG. 2. FIG. 4 is a cross-sectional view taken along a line IV-IV in FIG. 3. For clarity of the drawings, in FIG. 2, pressure chambers 34 and through holes 35, 36, and 39 (see FIG. 3) are omitted, and the nozzles 40 are shown to be larger than the nozzles 40 shown in FIGS. 3 and 4.

As shown in FIGS. 2 through 4, the inkjet head 3 includes a channel unit 22 and a piezoelectric actuator 23 (energy applying section). The channel unit 22 is formed with the nozzle 40 and an ink channel including the pressure chamber 34. The piezoelectric actuator 23 applies pressure (ejection energy) to ink in the pressure chamber 34, thereby ejecting ink through the nozzle 40 of the channel unit 22.

The channel unit 22 includes a cavity plate 30, a base plate 31, a manifold plate 32, and a nozzle plate 33. The cavity plate 30, the base plate 31, and the manifold plate 32 are made of metal material such as stainless steel. The nozzle plate 33 is made of piezoelectric material in the present embodiment. These four plates 30 through 33 are bonded with each other in a layered state.

The nozzle plate 33 is formed with a plurality of nozzles 40 which penetrates the nozzle plate 33. The plurality of nozzles 40 is arranged in the paper conveying direction (the up-down direction in FIG. 2) to constitute a nozzle array 41. Four nozzle arrays 41 are arranged in the scanning direction (the left-right direction in FIG. 2). The nozzles 40 belonging to these four nozzle arrays 41 eject ink in four colors of black, yellow, cyan, and magenta, respectively.

Figure 5A:
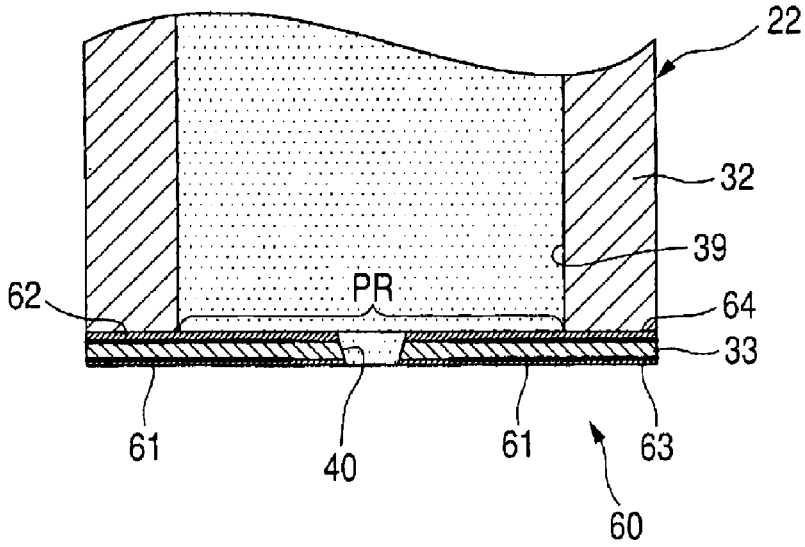
FIG. 5A is an enlarged cross-sectional view showing a nozzle peripheral part of FIG. 4, taken along a line VA-VA in FIG. 5B, where the line VA-VA passes through two of three first electrodes and is bent at the center of a nozzle.
Figure 5B:
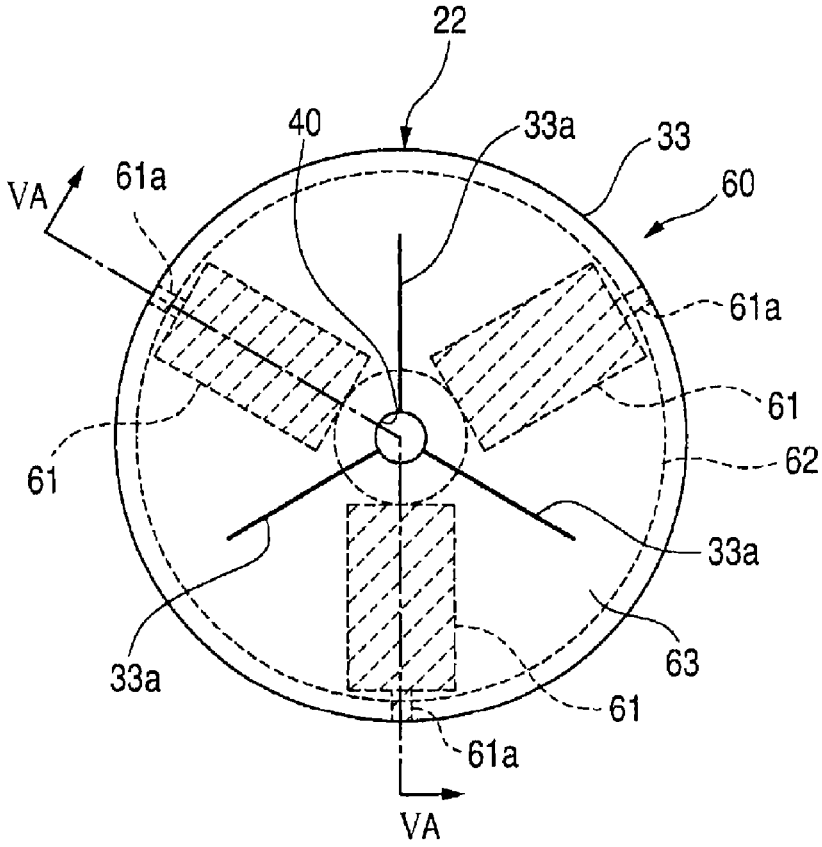
FIG. 5B is a bottom view showing the nozzle peripheral part of FIG. 5A.

FIG. 5A is an enlarged cross-sectional view showing the peripheral part of the nozzle 40 in FIG. 4, taken along a line VA-VA in FIG. 5B. Note that, the line VA-VA passes through two of three first electrodes 61 to be described later and is bent at the center of the nozzle 40. FIG. 5B is a bottom view showing the peripheral part of the nozzle 40 in FIG. 5A. While being described later in greater detail, as shown in FIGS. 5A and 5B, the channel unit 22 is provided with a piezoelectric section 60 that includes the nozzle plate 33 which itself is made of piezoelectric material. The piezoelectric section 60 is for detecting an ejection state of droplets through the nozzle 40 and for adjusting ejection direction of droplets. Further, as shown in FIG. 5B, three slits 33*a* are formed in a nozzle peripheral region PR (see FIG. 5A) of the nozzle plate 33, the three slits 33*a* extending radially from the nozzle 40. The nozzle peripheral region PR will be described later.

As shown in FIGS. 3 and 4, the cavity plate 30 is formed with the plurality of pressure chambers 34 in one-to-one correspondence with the plurality of nozzles 40. In a plan view, each pressure chamber 34 has substantially an elliptic shape elongated in the scanning direction, and is arranged so that the right end of the pressure chamber 34 overlaps the nozzle 40. The base plate 31 is formed with the through holes 35 and 36, respectively, at positions corresponding to the both longitudinal ends of the pressure chamber 34 in a plan view.

The manifold plate 32 is formed with four manifold channels 37 in one-to-one correspondence with the four nozzle arrays 41. As shown in FIGS. 2 through 4, each manifold channel 37 extends in the paper conveying direction at a position at the left side of a corresponding nozzle array 41. Further, each manifold channel 37 overlaps substantially the left half of a corresponding pressure chamber 34 in a plan view (see FIG. 3). As shown in FIG. 2, ends of the four manifold channels 37 (the upstream ends in the paper conveying direction; the upper ends in FIG. 2) are in communication with respective ones of the four ink supply ports 38 which are formed in the cavity plate 30 at the uppermost layer. The four ink supply ports 38 are connected to respective ones of the above-described four subsidiary tanks 4, so that ink within the subsidiary tanks 4 is supplied to the manifold channels 37 through the ink supply ports 38. The manifold plate 32 is formed with the through hole 39 at a position overlapping both the through hole 36 of the base plate 31 and the nozzle 40 of the nozzle plate 33 in a plan view.

As shown in FIG. 4, in the channel unit 22, the manifold channel 37 connecting to the ink supply port 38 is in communication with the pressure chamber 34 via the through hole 35. Further, the pressure chamber 34 is in communication with the nozzle 40 via the through holes 36 and 39. That is, the channel unit 22 is formed with a plurality of individual ink channels connecting the outlet of the manifold channel 37 with the nozzle 40 via the pressure chamber 34.

In the present embodiment, the ink channel including the ink supply port 38 (see FIG. 2), the manifold channel 37, the through hole 35, the pressure chamber 34, the through holes 36 and 39 serves as the liquid channel, the ink channel being in communication with the nozzle 40. Further, the layered member including the three metal plates 30, 31, and 32 serves as the channel structure member, the layered member being formed with the above-described ink channel and being bonded with the nozzle plate 33.

The piezoelectric actuator 23 includes a vibration plate 50, a piezoelectric layer 51, and a plurality of individual electrodes 52. The piezoelectric layer 51 is made of electrically-conductive material such as metal material. The piezoelectric layer 51 is bonded with the upper surface of the cavity plate 30 so as to cover the plurality of pressure chambers 34. The vibration plate 50 having electrical conductivity also functions as a common electrode for generating electric field in a part of the piezoelectric layer 51 sandwiched between the vibration plate 50 and the plurality of individual electrodes 52, as will be described later. The vibration plate 50 is connected to a ground line of a head driver 54 (see FIG. 6) so that the vibration plate 50 is always kept to a ground potential.

The piezoelectric layer 51 is made of piezoelectric material including lead zirconate titanate as the chief component, where the lead zirconate titanate is a mixed crystal of lead titanate and lead zirconate and is a ferroelectric substance. The piezoelectric layer 51 is arranged continually on the upper surface of the vibration plate 50, such that the piezoelectric layer 51 covers the plurality of pressure chambers 34. The piezoelectric layer 51 is polarized in its thickness direction in advance.

The plurality of individual electrodes 52 is provided on the upper surface of the piezoelectric layer 51 in one-to-one correspondence with the plurality of pressure chambers 34. In a plan view (see FIG. 3), each individual electrode 52 has substantially an elliptic shape smaller than the elliptic shape of the pressure chamber 34, and is arranged at such a position that the individual electrode 52 overlaps the substantial center part of the pressure chamber 34. One longitudinal end of the individual electrode 52 (the left end in FIG. 3) extends leftward to a position which does not overlap the pressure chamber 34 in a plan view, and the distal end of the individual electrode 52 serves as a contact point 52*a*. The head driver 54 is connected to the contact point 52*a* via a wiring member such as a flexible printed circuit board (FPC) not shown in the drawings. The head driver 54 supplies the plurality of individual electrodes 52 selectively with either one of a predetermined driving potential and a ground potential.

The operation of the piezoelectric actuator 23 having the above-described configuration will be described. When pressure is not applied to ink (i.e., when ink droplets are not ejected through the nozzles 40), the plurality of individual electrodes 52 is kept to a ground potential by the head driver 54. In that state, when the head driver 54 applies the predetermined driving potential to one of the plurality of individual electrodes 52, a potential difference is generated between the individual electrode 52 applied with the driving potential and the vibration plate 50 (the common electrode) kept to the ground potential, which generates electric field in the thickness direction in a part of the piezoelectric layer 51 sandwiched between the individual electrode 52 and the vibration plate 50. Here, if the polarization direction of the piezoelectric layer 51 is the same as the direction of the electric field, the piezoelectric layer 51 expands in the thickness direction and contracts in the surface direction. With this contraction deformation of the piezoelectric layer 51, a portion of the vibration plate 50 facing the pressure chamber 34 deforms such that the portion becomes convex toward the pressure chamber 34 side (unimorph deformation). At this time, the volume of the pressure chamber 34 decreases. Thus, the pressure of ink in the pressure chamber 34 increases, and an ink droplet is ejected through the nozzle 40 in communication with the pressure chamber 34.

As described above, as shown in FIG. 5B, the three slits 33*a* are formed in the nozzle peripheral region PR of the nozzle plate 33, the three slits 33*a* extending radially from the nozzle 40. Hence, the nozzle plate 33 can be deformed in the nozzle peripheral region PR to change the channel area of the nozzle 40, in response to the magnitude of pressure applied to ink within the pressure chamber 34 by the piezoelectric actuator 23. More specifically, the channel area of the nozzle 40 can be increased to eject a large droplet by applying large pressure to ink within the pressure chamber 34 by the piezoelectric actuator 23. Conversely, the channel area of the nozzle 40 can be decreased to eject a small droplet by applying small pressure to ink within the pressure chamber 34. In this way, because the three slits 33*a* are formed in the nozzle plate 33, the volume of a droplet can be adjusted easily.

If an increase in viscosity of ink due to drying, entering of an air bubble or dusts, or the like is generated within the nozzles 40 or the upstream ink channel of the channel unit 22, a droplet cannot be ejected through the nozzle 40, or the ejection direction becomes slanted from the normal direction (downward in the vertical direction in the present embodiment).

Thus, the inkjet head 3 of the present embodiment includes the piezoelectric section 60 that is operated during droplet ejection, in order to detect whether an ejection state of droplets through the nozzle 40 is normal and to adjust the ejection direction of droplets. Hereinafter, the specific configuration of the piezoelectric section 60 will be described in detail with reference to FIGS. 5A and 5B.

First, the nozzle plate 33 formed with the nozzles 40 is made of a piezoelectric polymer film including a ferroelectric polymer, such as a polyvinylidene fluoride (PVDF) film. As described above, the nozzle plate 33 is bonded with the lower surface of the manifold plate 32 formed with the through hole 39 constituting the ink channel upstream of the nozzle 40, allowing the nozzle 40 to be in communication with the lower end of the through hole 39. Here, as shown in FIG. 5A, the channel area (the cross-sectional area in a horizontal plane perpendicular to the axis of the through hole 39) of the through hole 39 located upstream of the nozzle 40 is sufficiently larger than the channel area of the nozzle 40. Hence, a region surrounding the nozzle 40 (referred to as the nozzle peripheral region PR) of the nozzle plate 33 is not bonded with the manifold plate 32 and thus can be deformed upward and downward. That is, the nozzle peripheral region PR is a region surrounding the nozzle 40 of the nozzle plate 33, the region being not fixed to the manifold plate 32 as shown in FIG. 5A.

In addition, as shown in FIGS. 5A and 5B, the first electrode 61 is arranged on the lower surface of the nozzle plate 33 in the peripheral part of each nozzle 40. More specifically, as shown in FIG. 5A, a part of each of the three first electrodes 61 is located within the nozzle peripheral region PR, while the remaining part of each of the three first electrodes 61 is located outside the nozzle peripheral region PR. The first electrode 61 is divided into three first electrodes 61 that are provided for each nozzle 40. Each of the divided three first electrodes 61 has a rectangular shape in a plan view. The divided three first electrodes 61 are arranged at equally-spaced intervals (an angle of 120 degrees) in the circumferential direction of the nozzle 40 at the periphery of the nozzle 40. Further, individual wires 61*a* are connected to respective ones of the three first electrodes 61. The three first electrodes 61 are connected to an electromotive-force detecting circuit 65 and a driving circuit 66 (electric-potential applying section) shown in FIG. 6 via the wires 61*a*.

In addition, as shown in FIG. 5B, the three slits 33*a* extending radially from the nozzle 40 are formed in the regions of the nozzle plate 33 between any two of the three first electrodes 61. With this configuration, each of the three parts of the nozzle plate 33 on which the three first electrodes 61 are arranged is separated from the adjacent parts by the slits 33*a*. Thus, each of the three parts of the nozzle plate 33 on which the first electrodes 61 are arranged can be readily deformed individually.

On the other hand, a ring-shaped (or disk shape with a center hole) second electrode 62 is provided on the upper surface of the nozzle plate 33 in the peripheral part of the nozzle 40. The second electrode 62 is in confrontation with all of the three first electrodes 61. In the present embodiment, as shown in FIG. 5A, a part of the second electrode 62 is located within the nozzle peripheral region PR, while the remaining part of the second electrode 62 is located outside the nozzle peripheral region PR. The second electrode 62 is connected to a ground line and is always kept to a ground potential.

Coating layers 63 and 64 made of insulating material are formed on the both surfaces of the nozzle plate 33, so as to completely cover the first electrodes 61 and the second electrode 62 arranged at the periphery of each nozzle 40. Because part of droplets ejected through the nozzle 40 tends to adhere to the coating layer 63 covering the lower surface of the nozzle plate 33, the coating layer 63 is preferably formed of liquid repellent material such as fluorine resin in order to prevent adhering droplets from staying around the nozzle 40.

Figure 6:
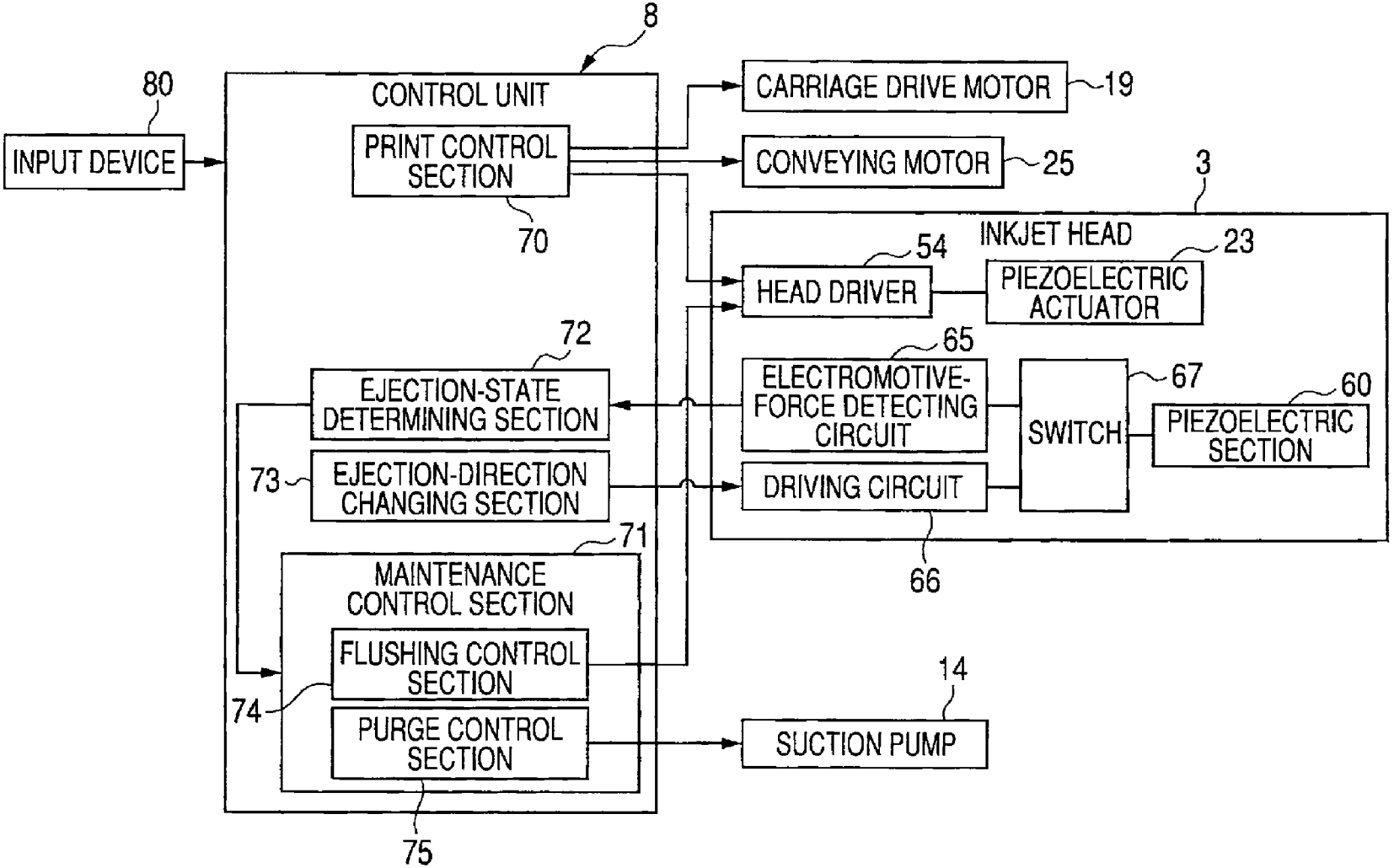
FIG. 6 is a block diagram schematically showing the electrical configuration of the printer.

As shown in the block diagram of FIG. 6, a switch 67 is provided between: the three first electrodes 61 of the piezoelectric section 60; and the electromotive-force detecting circuit 65 and the driving circuit 66. In a state where the switch 67 is switched so that the three first electrodes 61 are electrically connected to the electromotive-force detecting circuit 65, deformation of the nozzle plate 33 made of piezoelectric material enables the electromotive-force detecting circuit 65 to detect the potential differences between each of the three first electrodes 61 and the second electrode 62 (electromotive force). In contrast, in a state where the switch 67 is switched so that the three first electrodes 61 are electrically connected to the driving circuit 66, the driving circuit 66 can apply electric potentials to the three first electrodes 61 so that potential differences are generated between the first electrodes 61 and the second electrode 62 kept to the ground potential, thereby deforming the nozzle plate 33 made of piezoelectric material.

When the piezoelectric actuator 23 applies pressure (ejection energy) to ink within the pressure chamber 34 in order to eject a droplet through the nozzle 40, the pressure of ink causes the nozzle peripheral region PR of the nozzle plate 33 to be deformed, the nozzle peripheral region PR being not bonded with the manifold plate 32. The degree of this deformation differs depending on whether a droplet is actually ejected through the nozzle 40. In addition, in a case where a droplet is actually ejected, the degree of the deformation differs depending on the ejection direction. Accordingly, the electromotive-force detecting circuit 65 can detect the potential differences (electromotive force) between each of the three first electrodes 61 and the second electrode 62 in response to deformation modes of the nozzle plate 33, and determination can be made whether the ejection state of the nozzle 40 is normal based on the detected potential differences. The determination of the ejection state based on output signals from the piezoelectric section 60 will be described later in greater detail.

In contrast to the above-described detection of the ejection state, the driving circuit 66 (electric-potential applying section) can apply electric potentials individually to the three first electrodes 61, so that potential differences are generated between each of the three first electrodes 61 and the second electrode 62, thereby enabling the nozzle plate 33 to deform individually in the three regions in which the respective ones of the three first electrodes 61 are arranged. Accordingly, when the ejection direction of a nozzle 40 is slanted relative to the vertical direction which is the normal ejection direction, the ejection direction of the nozzle 40 can be adjusted by locally deforming a part of the nozzle plate 33. The adjustment of the ejection direction utilizing the piezoelectric section 60 will also be described later in greater detail.

Next, the electrical configuration of the printer 1 will be described with reference to the block diagram in FIG. 6, wherein the description will be mainly focused on the control unit 8.

The control unit 8 shown in FIG. 6 includes a CPU (Central Processing Unit), a ROM (Read Only Memory) that stores various programs, data, etc. for controlling the overall operations of the printer 1, a RAM (Random Access Memory) that temporarily stores data etc. processed by the CPU, and the like.

As shown in FIG. 6, the control unit 8 includes a print control section 70, a maintenance control section 71, an ejection-state determining section 72, and an ejection-direction changing section 73. The print control section 70 controls printing performed on printing paper. The maintenance control section 71 performs a maintenance operation for recovering the ejection performance of the nozzles 40. The ejection-state determining section 72 determines the ejection state of the nozzles 40 based on outputs from the piezoelectric section 60. The ejection-direction changing section 73 adjusts the ejection direction of the nozzles 40 by using the piezoelectric section 60. Note that the CPU executes various control programs stored in the ROM to implement the functions of each section of the control unit 8 (i.e., the print control section 70, the maintenance control section 71, the ejection-state determining section 72, and the ejection-direction changing section 73).

The print control section 70 controls each of the carriage drive motor 19 that drives the carriage 2 in a reciprocating motion, the head driver 54 of the inkjet head 3, a conveying motor 25 included in a paper conveying mechanism (not shown) that conveys printing paper P, and the like, based on data inputted from an input device 80 such as a personal computer, thereby printing an image and the like on the printing paper P.

The maintenance control section 71 (recovery control section) includes a flushing control section 74 and a purge control section 75. The flushing control section 74 controls the head driver 54 of the inkjet head 3 to drive the piezoelectric actuator 23 to apply pressure to ink within the pressure chamber 34, thereby performing a flushing operation during which the inkjet head 3 ejects ink droplets continuously a plurality of times from the nozzles 40. The purge control section 75 controls each section of the maintenance unit 7, such as the suction pump 14, to perform a suction purge operation during which ink is sucked and discharged through the plurality of nozzles 40 of the inkjet head 3 via the cap member 13. In the present embodiment, the maintenance unit 7 including the suction pump 14 and the like, the piezoelectric actuator 23 that applies pressure to ink when flushing is performed, and the head driver 54 that drives the piezoelectric actuator 23 serve as the recovering section that discharges ink through the nozzles 40 to recover the ejection performance.

<Determination of Ejection State>

Next, the ejection-state determining section 72 will be described in detail. At timing when a nozzle 40 ejects a droplet, the ejection-state determining section 72 determines whether the ejection state of a droplet of the nozzle 40 is normal, based on the potential differences between each of the three first electrodes 61 and the second electrode 62 of the piezoelectric section 60, the potential differences being detected by the electromotive-force detecting circuit 65.

Figure 7A:
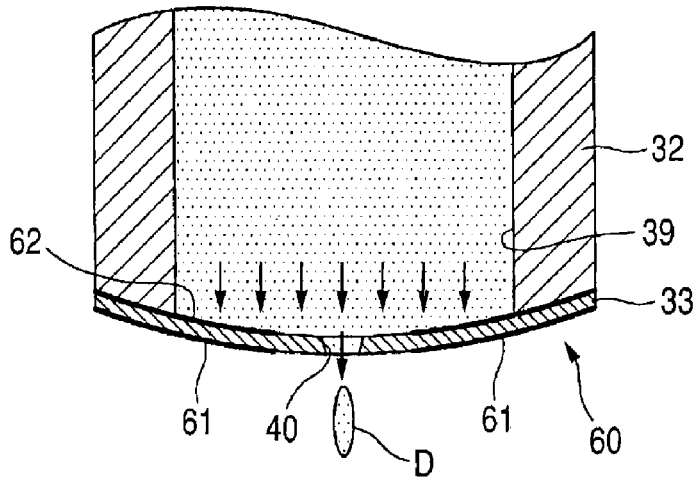
Figure 7B:
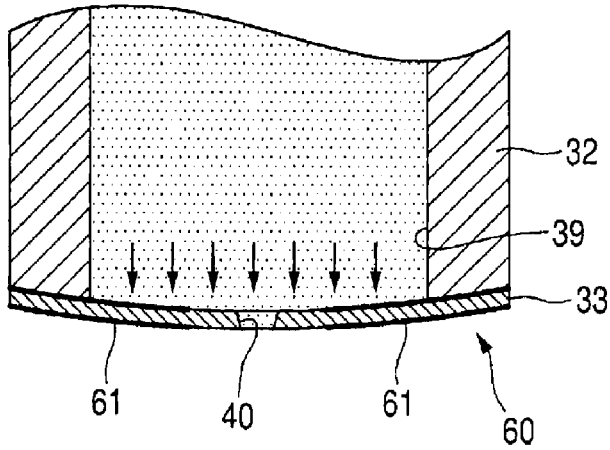
Figure 7C:
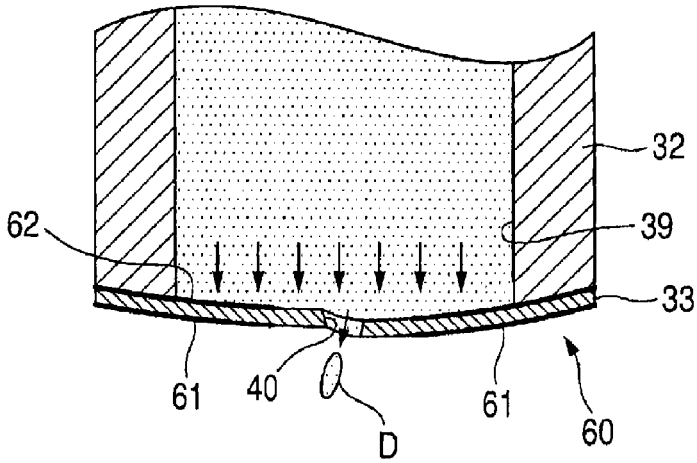

FIGS. 7A through 7C are cross-sectional views showing the deformation states of the nozzle plate 33 in the nozzle peripheral region PR (FIG. 5A) when pressure is applied to ink within the pressure chamber 34 by the piezoelectric actuator 23. Here, FIG. 7A shows a normal ejection state, FIG. 7B shows a non-ejection state, and FIG. 7C shows a state where the ejection direction is slanted. For simplicity of the drawings, the coating layers 63 and 64 shown in FIGS. 5A and 5B are omitted in FIGS. 7A through 7C.

FIG. 7A shows a state where a droplet D is normally ejected downward in the vertical direction from the nozzle 40 in communication with the pressure chamber 34 when the piezoelectric actuator 23 applies pressure to ink within the pressure chamber 34. In this state, the nozzle peripheral region PR of the nozzle plate 33 deforms to be convex downward substantially uniformly with respect to the circumferential direction of the nozzle 40. Further, the amount of deformation (the amount of downward displacement) is relatively large. Hence, the potential differences between each of the three first electrodes 61 and the second electrode 62 indicate large values greater than or equal to a predetermined value, the potential differences being generated in response to deformation of the nozzle plate 33. In addition, the potential differences between each of the three first electrodes 61 and the second electrode 62 are approximately the same among the three first electrodes 61.

FIG. 7B shows a state where a droplet is not ejected from the nozzle 40 in communication with the pressure chamber 34 when the piezoelectric actuator 23 applies pressure to ink within the pressure chamber 34. In this state, the nozzle peripheral region PR of the nozzle plate 33 deforms slightly to be convex downward. However, the amount of deformation is considerably smaller than the case when the droplet D is ejected as shown in FIG. 7A. One of the reasons is that an air bubble sometimes exists in the ink channel and the pressure applied to ink within the pressure chamber 34 does not reach the nozzle 40 effectively. Hence, the potential differences between each of the three first electrodes 61 and the second electrode 62 indicate small values less than a predetermined value.

FIG. 7C shows a state where a droplet D is ejected from the nozzle 40, but the ejection direction of the droplet D is deviated from the vertical direction, which is the normal ejection direction, because the axis of the nozzle 40 is slanted relative to the vertical direction. In this state, the nozzle peripheral region PR of the nozzle plate 33 deforms in a non-uniform manner with respect to the circumferential direction of the nozzle 40. In other words, the amounts of deformation are different with respect to the circumferential direction of the nozzle 40. Thus, the potential differences between each of the three first electrodes 61 and the second electrode 62 are different among the three first electrodes 61.

Figure 8:
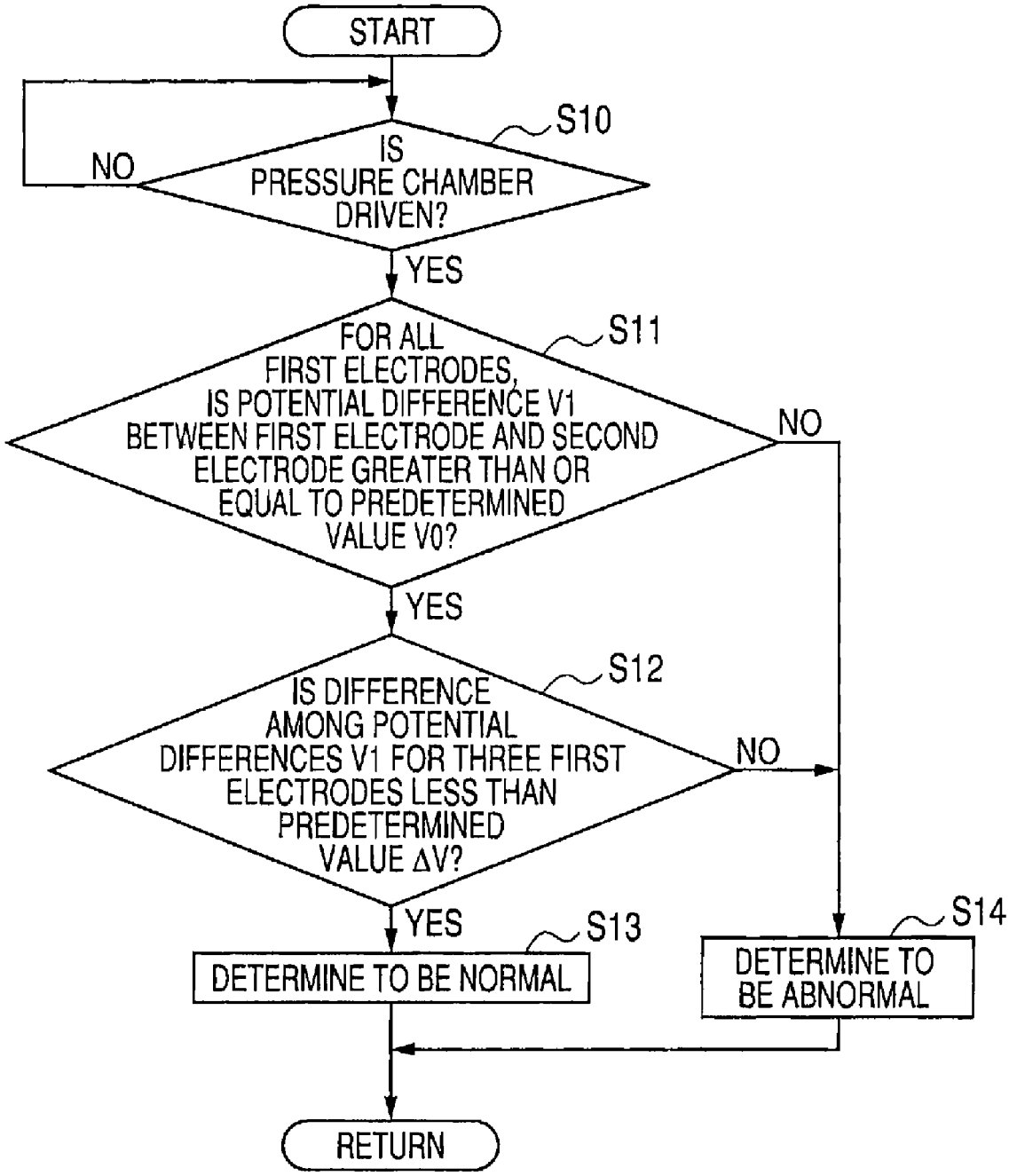
FIG. 8 is a flowchart showing a process for determining an ejection state and for maintenance.

Accordingly, the ejection-state determining section 72 determines whether the ejection state of the nozzle 40 is normal, based on the potential differences between each of the three first electrodes 61 and the second electrode 62 as described below, the potential differences being detected by the electromotive-force detecting circuit 65. FIG. 8 is a flowchart for determining the ejection state. Note that Si (i=10, 11, 12, . . . ) in FIG. 8 indicates step numbers.

The process for determining the ejection state shown in FIG. 8 is executed for each of all the nozzles 40. Further, the process for determining the ejection state can be executed whenever the nozzles 40 can eject droplets. Accordingly, the process may be executed during a normal printing operation where images and the like are printed on printing paper P, and/or during a flushing operation where droplets are ejected continuously toward the waste ink receiver 12 of the maintenance unit 7.

First, in S10 the ejection-state determining section 72 determines whether the print control section 70 of the control unit 8 has outputted a command to the piezoelectric actuator 23, the command being for ejecting a droplet from the nozzle 40 that is the subject of the ejection state determination. If the command has been outputted, the ejection-state determining section 72 determines that piezoelectric actuator 23 has applied pressure to ink within the pressure chamber 34 in communication with this nozzle 40 (that is, the pressure chamber 34 has been driven) (S10: Yes).

In S11 the ejection-state determining section 72 determines whether, for all of the three first electrodes 61, the potential difference V1 between the first electrode 61 and the second electrode 62 is greater than or equal to a predetermined value V0, the potential difference V1 being detected by the electromotive-force detecting circuit 65. If the potential differences V1 for all of the three first electrodes 61 are greater than or equal to the predetermined value V0 (S11: Yes), the ejection-state determining section 72 proceeds to S12 by determining that the nozzle plate 33 deforms greatly and thus a droplet has been ejected (the state shown in FIG. 7A). In contrast, if the potential difference V1 between at least one first electrode 61 and the second electrode 62 is less than the predetermined value V0 (S11: No), the ejection-state determining section 72 determines that the deformation amount of the nozzle plate 33 is small and thus a droplet has not been ejected (the state shown in FIG. 7B), thereby determining that the ejection state is abnormal (S14).

In S12 the ejection-state determining section 72 determines whether the difference among the potential differences V1 between the three first electrodes 61 and the second electrode 62 is less than a predetermined value ΔV (S12). In other words, the ejection-state determining section 72 determines whether the difference between the largest potential difference V1 and the smallest potential difference V1 is less than the predetermined value ΔV. If the difference among the potential differences V1 is less than the predetermined value ΔV (S12: Yes), the ejection-state determining section 72 determines that the deformation amount of the nozzle plate 33 is substantially uniform in the circumferential direction of the nozzle 40 and thus the ejection direction of a droplet is the normal direction (the state shown in FIG. 7A), thereby determining that the ejection state is normal (S13). In contrast, if the difference among the potential differences V1 is greater than or equal to the predetermined value ΔV (S12: No), the ejection-state determining section 72 determines that the deformation amount of the nozzle peripheral region PR of the nozzle plate 33 is non-uniform (i.e., large variance) in the circumferential direction of the nozzle 40 and thus the ejection direction is slanted relative to the normal direction (the state shown in FIG. 7C), thereby determining that the ejection state is abnormal (S14).

As described above, in the present embodiment, the three slits 33*a* are formed in the nozzle plate 33 in the regions between any two of the three first electrodes 61, the three slits 33*a* extending radially from the nozzle 40 (see FIG. 5B). Hence, the nozzle plate 33 can deform greatly in each of the three regions where the three first electrodes 61 are arranged, thereby further facilitating detection of the non-uniformity in deformation of the nozzle peripheral region PR of the nozzle plate 33 with respect to the circumferential direction when a droplet is ejected.

When the ejection state of one or more nozzles 40 has been determined to be abnormal at the completion of ejection state determination for all the nozzles 40, the maintenance control section 71 first controls the inkjet head 3 to perform a flushing operation in order to recover the ejection performance of the nozzles 40. More specifically, the flushing control section 74 controls the head driver 54 to drive the piezoelectric actuator 23 to eject ink droplets continuously a plurality of times through all the nozzles 40.

During this flushing operation, the ejection-state determining section 72 again determines whether the ejection state of a droplet is normal for all the nozzles 40, based on the potential differences between each of the three first electrodes 61 and the second electrode 62, the potential differences being detected by the electromotive-force detecting circuit 65 (see FIG. 8).

If the ejection-state determining section 72 determines that the ejection state of at least one of the nozzles 40 is abnormal at least at the final ejection of a plurality of times of droplet ejection in the flushing operation, the maintenance control section 71 controls the maintenance unit 7 to perform a suction purge operation by determining that the abnormal ejection of the nozzles 40 has not been recovered by the flushing operation. More specifically, the purge control section 75 controls each section of the maintenance unit 7, such as the suction pump 14, to suck and discharge ink through all the nozzles 40 via the cap member 13. In contrast, if the ejection-state determining section 72 determines that the ejection state of all the nozzles 40 is normal at the final ejection of a droplet in the flushing operation, the maintenance control section 71 ends the maintenance process by determining that the abnormal ejection of the nozzles 40 has been recovered by the flushing operation.

As described above, the ejection-state determining section 72 determines the ejection state for each of all the nozzles 40. In other words, the ejection-state determining section 72 is capable of identifying the nozzle 40 in an abnormal ejection state. Hence, the flushing control section 74 can control the head driver 54 to perform flushing only for the nozzle 40 that has been determined to be in an abnormal ejection state by the ejection-state determining section 72, and not to perform flushing for the nozzle 40 that has been determined to be in a normal ejection state. Alternatively, the flushing control section 74 may control the head driver 54 to perform flushing with an increased number of flushing ejection times for the nozzle 40 that has been determined to be in an abnormal ejection state, compared with the nozzle 40 in a normal ejection state. With these controls, the amount of ink discharged during the flushing operation can be reduced.

<Change of Ejection Direction>

Next, the ejection-direction changing section 73 will be described in detail. When the ejection direction of a droplet from a nozzle 40 is slanted relative to the normal direction (downward in the vertical direction), the ejection-direction changing section 73 controls the driving circuit 66 (electric-potential applying section) to adjust the electric potential applied to each of the three first electrodes 61 so that the ejection direction of droplets becomes the normal direction, thereby changing the ejection direction.

In the present embodiment, information on whether the ejection direction of each nozzle 40 is slanted relative to the normal direction and, if slanted, in which direction and by what angle the ejection direction is slanted is detected in advance during inspection processes or the like at the manufacture stage of the printer 1. The detection results (i.e., the information on the slant direction and the slant angle) are stored in the ROM of the control unit 8. In that state, the ejection-direction changing section 73 refers to the ROM to identify the nozzle 40 having slanted ejection direction, and controls the piezoelectric section 60 to adjust the ejection direction of the nozzle 40 to become the normal direction (downward in the vertical direction).

However, the detection of the ejection direction of the nozzles 40 may be performed at the time other than the manufacture stage of the printer 1. More specifically, if during a use of the printer 1 the ejection-state determining section 72 can infer an approximate ejection direction of the nozzle 40 based on the potential differences between the each of the three first electrodes 61 and the second electrode 62, the ejection-direction changing section 73 may adjust the ejection direction of the nozzle 40 based on the inferred ejection direction.

Figure 9A:
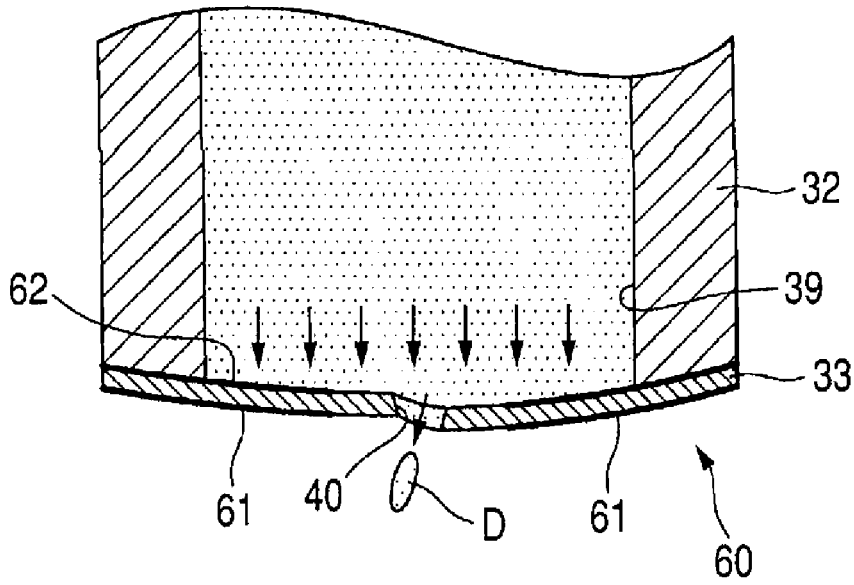
Figure 9B:
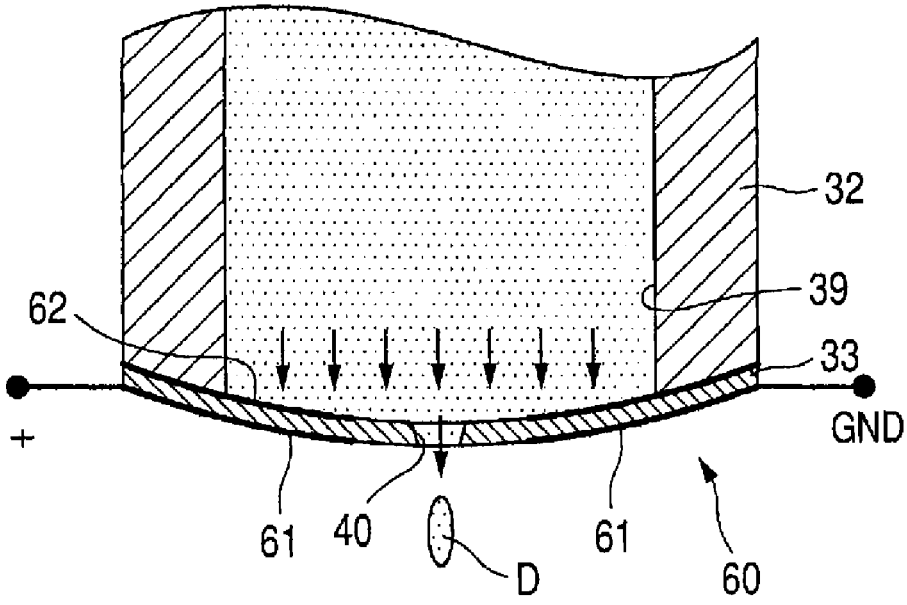

FIGS. 9A and 9B are cross-sectional views showing the deformation states of the nozzle plate 33 in the nozzle peripheral region PR (see FIG. 5A) of the nozzle 40 whose ejection direction of a droplet is slanted, wherein FIG. 9A shows a state prior to changing the ejection direction, and FIG. 9B shows a state after changing the ejection direction. For simplicity of the drawings, the coating layers 63 and 64 shown in FIGS. 5A and 5B are omitted in FIGS. 9A and 9B.

FIG. 9A shows a state where the axis direction of a nozzle 40 (i.e., the ejection direction of a droplet D indicated by the arrow) is slanted leftward in the drawing relative to the vertical direction. In this state, the deformation of the nozzle peripheral region PR of the nozzle plate 33 is smaller at the left side part than at the right side part, the left side being the side toward which the ejection direction is slanted relative to the vertical direction.

In this case, as shown in FIG. 9B, the ejection-direction changing section 73 controls the driving circuit 66 to apply a predetermined driving potential (shown as "+" in FIG. 9B) to the first electrode 61 that is arranged at the left side part (in the drawing) of the nozzle plate 33 where deformation of the nozzle plate 33 is small in FIG. 9A. Then, because a potential difference is generated between the first electrode 61 applied with the driving potential and the second electrode 62, the left side part of the nozzle plate 33 sandwiched between these electrodes contracts in the surface direction, so that the left side part of the nozzle plate 33 deforms to be convex downward.

The ejection-direction changing section 73 also controls the driving circuit 66 to keep the first electrode 61 arranged at the right side part (in the drawing) of the nozzle plate 33 to a ground potential (shown as "GND" in FIG. 9B), the right side part of the nozzle plate 33 having large deformation in FIG. 9A. At this time, because no potential difference is generated between the first electrode 61 kept to the ground potential and the second electrode 62 originally kept to the ground potential, piezoelectric deformation is not generated at the right side part of the nozzle plate 33 sandwiched between these electrodes.

In other words, the amount of deformation at the left side part (in the drawing) of the nozzle plate 33 increases, whereas the amount of deformation at the right side part of the nozzle plate 33 does not change. Accordingly, as shown in FIG. 9B, the amount of deformation of the nozzle plate 33 becomes approximately the same between the left and right sides of the nozzle 40, thereby changing the axis direction of the nozzle 40 (the ejection direction of the droplet D) to the vertical direction.

In contrast to the case of FIG. 9A, if the ejection direction of a droplet D is slanted toward the right side relative to the vertically downward direction, the driving circuit 66 can apply a driving potential to the first electrode 61 arranged at the right side of the nozzle 40, thereby increasing the amount of deformation of the nozzle plate 33 at the right side. In this way, the ejection direction can be changed to the vertically downward direction.

In the present embodiment, the three slits 33*a* are formed in the nozzle plate 33 in the regions between any two of the three first electrodes 61, the three slits 33*a* extending radially from the nozzle 40 (see FIG. 5B). Hence, the nozzle plate 33 can deform greatly and independently in each of the three regions where the three first electrodes 61 are arranged.

According to the above-described printer 1, the following advantageous effects can be obtained.

The channel unit 22 of the inkjet head 3 is provided integrally with the piezoelectric section 60 including the nozzle plate 33 made of piezoelectric material and the first and second electrodes 61 and 62 arranged respectively on the both surfaces of the nozzle peripheral region PR of the nozzle plate 33. Thus, the ejection-state determining section 72 can determine whether the ejection state of droplets is normal, based on the potential difference between each of the first electrodes 61 and the second electrode 62, the potential difference being generated in response to deformation of the nozzle plate 33 when a droplet is ejected through the nozzle 40.

In addition, the configuration for detecting the ejection state of the nozzles 40 (the piezoelectric section 60) is integrated with the channel unit 22. Hence, addition of this configuration does not cause the size of the printer 1 to increase. Further, determination of the ejection state can be performed whenever droplets can be ejected through the nozzles 40. Accordingly, it is possible to detect whether the ejection state of the nozzles 40 is normal, even when normal droplet ejection is being performed through the nozzles 40 and/or when droplet ejection is being performed for recovering the ejection performance of the nozzles 40 (flushing). Thus, abnormal ejection of the nozzles 40 can be detected promptly.

In addition, if there is a nozzle 40 whose ejection direction is slanted relative to the normal direction, the ejection-direction changing section 73 can control the driving circuit 66 to adjust the electric potentials applied to the first electrodes 61 of the piezoelectric section 60, thereby changing the ejection direction of droplets.

While the invention has been described in detail with reference to the above aspects thereof, it would be apparent to those skilled in the art that various changes and modifications may be made therein without departing from the scope of the claims. Here, like parts and components are designated by the same reference numerals to avoid duplicating description.

[1] The number of the first electrodes, the number of slits formed in the nozzle plate, the shapes of the first and second electrodes, and the like are not limited to those in the above-described embodiment, and may be changed appropriately according to needs. As the number of the slits increases (that is, as the number of division of the nozzle plate increases), the ejection direction can be detected more finely and also the ejection direction can be adjusted more finely.

Further, the second electrode may be divided into a plurality of number of second electrodes which is the same number as the first electrodes, and the same number of the first and second electrodes may be arranged in confrontation with each other with the nozzle plate interposed therebetween.

[2] In the above-described embodiment, the inkjet head 3 that ejects droplets is a serial-type inkjet head mounted on the carriage that moves in a direction in a reciprocating manner. However, the invention can also be applied to a printer including a fixed line-type inkjet head having one or more nozzle arrays extending in the width direction of printing paper.

With a serial-type inkjet head, even when abnormal ejection occurs at part of the nozzles, the nozzles in a abnormal ejection state can be covered (compensated) to some extent by the other nozzles in a normal ejection state, by adjusting the scanning speed of the carriage, adjusting the ejection timing of the nozzles in a normal ejection state, or the like. However, because the fixed line-type inkjet head does not move, it is impossible to perform the above-described compensation by the nozzles in a normal ejection state. Accordingly, it is especially effective to apply the configuration of the invention to the fixed line-type inkjet head because nozzles in an abnormal ejection state can be detected promptly and because the ejection direction can be adjusted.

[3] In the above-described embodiment, the piezoelectric section 60 provided integrally to the inkjet head 3 is used both for detection of the ejection state and for adjustments of the ejection direction. However, the piezoelectric section may be used only for detection of the ejection state.

Figure 10:
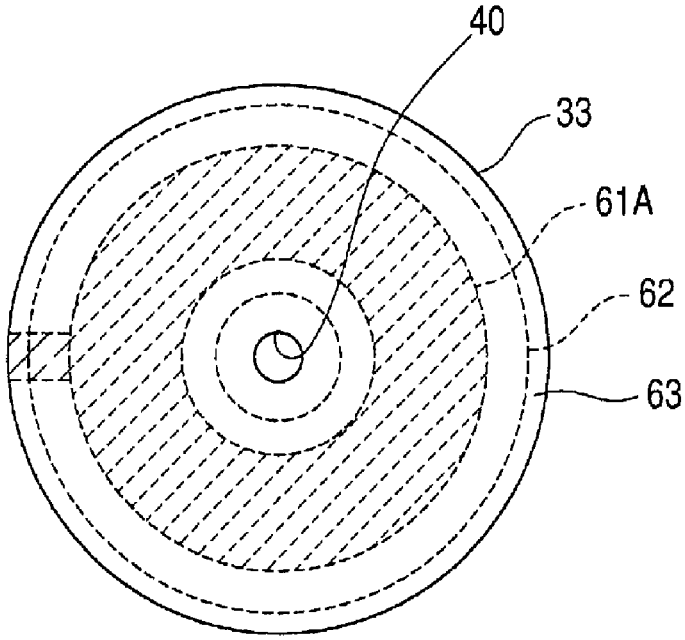
FIG. 10 is a bottom view showing a nozzle peripheral part of an inkjet head according to a modification.

If the piezoelectric section is used only for detection of the ejection state, it is not necessary to independently deform a plurality of parts of the nozzle peripheral region PR of the nozzle plate 33. Hence, for example, as shown in FIG. 10, a single ring-shaped first electrode 61A may be provided to the peripheral region of a nozzle 40 (surrounding the nozzle 40), the first electrode 61A not being divided into a plurality of electrodes. In this case, however, it is not possible to detect individual deformation of each of a plurality of parts of the nozzle plate 33 with respect to the circumferential direction of the nozzle 40. Thus, the ejection-state determining section cannot detect whether the ejection direction of a droplet is slanted, but detects only whether a droplet has been ejected.

Figure 11:
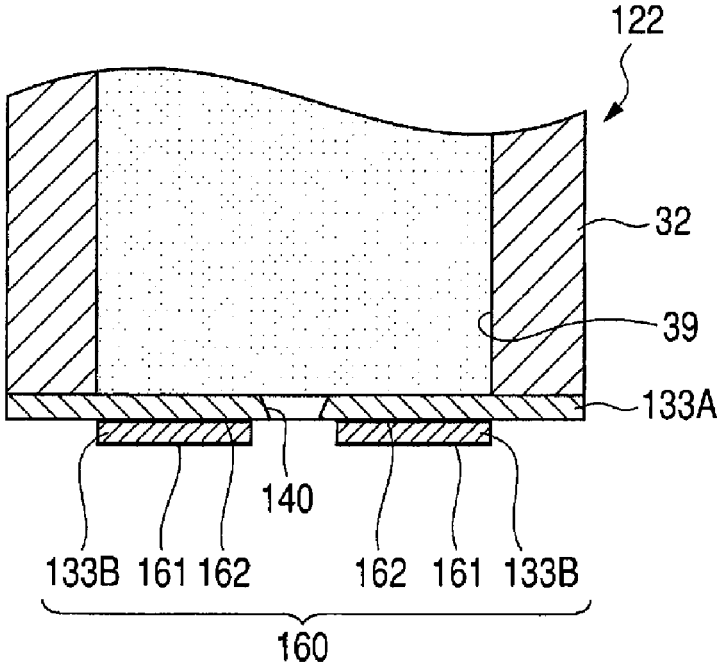
FIG. 11 is an enlarged cross-sectional view showing a nozzle peripheral part of an inkjet head according to another modification.

[4] In the above-described embodiment, the nozzle plate 33 itself is made of piezoelectric material. However, a piezoelectric element may be attached to the nozzle plate made of non-piezoelectric material. FIG. 11 shows a channel unit 122 according to another modification. The channel unit 122 includes the manifold plate 32 formed with the through hole 39. A nozzle plate 133A made of material such as PET (polyethylene terephthalate) is fixed to the manifold plate 32. The nozzle plate 133A is formed with a nozzle 140 that penetrates the nozzle plate 133A. A piezoelectric section 160 includes piezoelectric elements 133B, first electrodes 161, and second electrodes 162. The piezoelectric elements 133B are attached to the nozzle plate 133A, by adhesive bonding, vapor deposition, aerosol deposition method, or the like. Here, the piezoelectric elements 133B, the first electrodes 161, and the second electrodes 162 can be provided in various arrangement. For example, the piezoelectric elements 133B, the first electrodes 161, and the second electrodes 162 may have rectangular shapes, and may be arranged at 120 degree intervals like the arrangement of the three first electrodes 61 shown in FIG. 5B. Alternatively, the piezoelectric element 133B, the first electrode 161, and the second electrode 162 may have ring shapes similar to the arrangement shown in FIG. 10. According to this modification, the effects similar to those in the above-described embodiment can be obtained.

[5] In the above-described embodiment, as shown in FIG. 5A, a part of each of the three first electrodes 61 is located within the nozzle peripheral region PR, while the remaining part of each of the three first electrodes 61 is located outside the nozzle peripheral region PR. However, the entirety of each of the three first electrodes 61 may be located within the nozzle peripheral region PR. That is, at least part of each of the first electrodes 61 needs to be located within the nozzle peripheral region PR. The same goes for the second electrode 62.

[6] According to the above-described embodiment, in S11 in the flowchart of FIG. 8, the ejection-state determining section 72 determines whether, for all of the three first electrodes 61, the potential difference V1 between the first electrode 61 and the second electrode 62 is greater than or equal to the predetermined value V0. Here, if the potential difference V1 between at least one first electrode 61 and the second electrode 62 is less than the predetermined value V0 (S11: No), the ejection-state determining section 72 determines that the ejection state is abnormal (S14).

However, in the step corresponding to S11, the ejection-state determining section 72 may determine whether, for all of the three first electrodes 61, the potential difference V1 between the first electrode 61 and the second electrode 62 is less than or equal to a predetermined value V0' (V0' is a value different from V0). Here, if the potential differences V1 for all of the three first electrodes 61 are less than or equal to the predetermined value V0', the ejection-state determining section 72 may determine that the ejection state is abnormal by determining that the deformation amount of the nozzle plate 33 is small and thus a droplet has not been ejected.

[7] In the above-described embodiment and modifications, the invention is applied to an inkjet-type printer which records images and the like by ejecting ink droplets on recording paper. However, the application of the invention is not limited to such a printer. That is, the invention can be applied to various droplet ejecting devices that eject various kinds of liquid on an object, depending on the usage.

What is claimed is:

1. A droplet ejecting device comprising:

a channel unit formed with at least one nozzle that eject a liquid droplet and with at least one liquid channel in communication with the at least one nozzle, the at least one liquid channel having a channel area larger than the at least one nozzle, the channel unit comprising:

a nozzle plate formed with the at least one nozzle and including a piezoelectric section, the nozzle plate having a first surface and a second surface opposite the first surface;

a channel structure member fixed to the nozzle plate and formed with the at least one liquid channel;

a first electrode provided on the first surface, at least part of the first electrode being arranged in a nozzle peripheral region of the at least one nozzle; and a second electrode provided on the second surface, at least part of the second electrode being arranged in the nozzle peripheral region of the at least one nozzle;

an energy applying section that applies ejection energy to liquid in the at least one liquid channel; and an ejection-state determining section that determines whether an ejection state of a droplet is normal for the at least one nozzle, based on a potential difference between the first electrode and the second electrode when the energy applying section applies the ejection energy to the liquid in the at least one liquid channel.

2. The droplet ejecting device according to claim 1, wherein the ejection-state determining section determines that a liquid droplet is ejected from the at least one nozzle if the potential difference between the first electrode and the second electrode is greater than or equal to a predetermined value; and wherein the ejection-state determining section determines that a liquid droplet is not ejected from the at least one nozzle if the potential difference between the first electrode and the second electrode is less than the predetermined value.

3. The droplet ejecting device according to claim 1, wherein the first electrode is divided into a plurality of first electrodes, at least part of each of the plurality of first electrodes being arranged in the nozzle peripheral region of the at least one nozzle.

4. The droplet ejecting device according to claim 3, wherein the ejection-state determining section determines whether an ejection direction of a droplet is normal for the at least one nozzle, based on potential differences between each of the plurality of first electrodes and the second electrode.

5. The droplet ejecting device according to claim 3, wherein a slit is formed in a region of the nozzle plate between any two of the plurality of first electrodes, the slit extending radially from the at least one nozzle.

6. The droplet ejecting device according to claim 5, further comprising:

an electric-potential applying section that applies electric potentials independently to respective ones of the plurality of first electrodes; and an ejection-direction changing section that controls the electric-potential applying section to adjust the electric potentials of the respective ones of the plurality of first electrodes, thereby changing an ejection direction of a droplet for the at least one nozzle.

7. The droplet ejecting device according to claim 3, wherein the plurality of first electrodes comprises three first electrodes arranged in 120-degree equally-spaced intervals around the at least one nozzle.

8. The droplet ejecting device according to claim 1, further comprising:

a recovering section that recovers ejection performance of the at least one nozzle by ejecting a droplet from the at least one nozzle; and a recovery control section that controls the recovering section, wherein the recovery control section controls the recovering section to perform an ejection-performance recovering operation for the at least one nozzle, when the ejection-state determining section determines that the ejection state of a droplet is abnormal for the at least one nozzle.

9. The droplet ejecting device according to claim 1, wherein the first electrode is divided into a plurality of first electrodes, at least part of each of the plurality of first electrodes being arranged in the nozzle peripheral region of the at least one nozzle.

10. The droplet ejecting device according to claim 1, wherein the first electrode has a ring shape surrounding the at least one nozzle.

11. The droplet ejecting device according to claim 1, wherein the nozzle plate itself is made of piezoelectric material.

12. The droplet ejecting device according to claim 1, wherein the nozzle plate comprises:

a nozzle-plate main body made of non-piezoelectric material; and a piezoelectric element made of piezoelectric material and attached to the nozzle-plate main body.

13. The droplet ejecting device according to claim 1, wherein the at least one nozzle ejects an ink droplet on a recording medium; and wherein the droplet ejecting device functions as an inkjet recording device.

* * * * *